US011213135B2

(12) United States Patent
Chen

(10) Patent No.: US 11,213,135 B2
(45) Date of Patent: Jan. 4, 2022

(54) SUNSHADED SWING SEAT

(71) Applicant: Samuel Chen, Causeway Bay (CN)

(72) Inventor: Samuel Chen, Causeway Bay (CN)

( * ) Notice: Subject to any disclaimer, the term of this patent is extended or adjusted under 35 U.S.C. 154(b) by 32 days.

(21) Appl. No.: 16/996,164

(22) Filed: Aug. 18, 2020

(65) Prior Publication Data

US 2020/0375366 A1 Dec. 3, 2020

Related U.S. Application Data

(63) Continuation-in-part of application No. 16/238,909, filed on Jan. 3, 2019, now abandoned, which is a continuation-in-part of application No. 29/661,378, filed on Aug. 27, 2018, now Pat. No. Des. 879,894.

(51) Int. Cl.

| | |
|---|---|
| ***A47C 7/66*** | (2006.01) |
| ***A47C 7/72*** | (2006.01) |
| ***A45B 23/00*** | (2006.01) |
| ***A47C 3/025*** | (2006.01) |
| ***A47C 7/74*** | (2006.01) |

(52) U.S. Cl.

CPC ..... *A47C 7/725* (2013.01); *A45B 23/00* (2013.01); *A47C 3/0255* (2013.01); *A47C 7/66* (2013.01); *A47C 7/72* (2013.01); *A47C 7/744* (2013.01); *A45B 2023/0093* (2013.01)

(58) Field of Classification Search

None

See application file for complete search history.

(56) References Cited

U.S. PATENT DOCUMENTS

| | | | |
|---|---|---|---|
| 3,738,703 | A | 6/1973 | Kunimatu |
| 4,030,748 | A | 6/1977 | Brock |
| 4,639,036 | A | 1/1987 | Nichols |
| 4,809,724 | A | 4/1989 | Fuser |
| 4,865,381 | A | 9/1989 | Van Rogue |
| 4,898,198 | A | 6/1990 | Casttlebury |
| 5,000,210 | A | 3/1991 | Worthington, Jr. |
| 5,033,528 | A | 7/1991 | Volcani |
| 5,096,257 | A | 3/1992 | Clark |
| 5,135,281 | A | 8/1992 | Pappalardo |
| 5,320,405 | A | 6/1994 | Foster |
| 5,397,268 | A | 3/1995 | Chang |
| 5,441,067 | A | 8/1995 | James |

(Continued)

FOREIGN PATENT DOCUMENTS

| | | |
|---|---|---|
| CN | 207041292 U | 2/2018 |
| EP | 1487304 | 12/2004 |

(Continued)

*Primary Examiner* — David E Allred

(74) *Attorney, Agent, or Firm* — Clement Cheng

(57) ABSTRACT

A sunshaded swing seat includes a suspension frame including a main horizontal beam, and a pair of extension members mounted to the main horizontal beam. The pair of extension members forms four tips. Tension supports extend downwardly from the four tips, and each tension support extends downwardly from each tip. A swing seat has a rigid swing seat rim, and the swing seat has a fabric seat body attached to the swing seat rim and forming a seat hollow. A shade has a upper panel mounted over the swing seat. The shade optionally further includes a shade left side panel and a shade right side panel. The shade left side panel has a shade left arc on its lower edge.

17 Claims, 6 Drawing Sheets

(56) References Cited

U.S. PATENT DOCUMENTS

| | | | | |
|---|---|---|---|---|
| 5,967,601 | A | 10/1999 | Gillins | |
| 6,024,264 | A * | 2/2000 | Java | A45B 3/00 135/16 |
| 6,293,292 | B1 | 9/2001 | Watzke | |
| 6,298,866 | B1 * | 10/2001 | Molnar, IV | A45B 3/00 108/50.12 |
| 6,405,742 | B1 | 6/2002 | Driscoll | |
| 6,682,000 | B1 * | 1/2004 | Apple | A45B 3/00 239/289 |
| 6,789,557 | B1 | 9/2004 | Wahl, Jr. | |
| 7,048,333 | B2 | 5/2006 | Martinez | |
| 7,245,990 | B2 | 7/2007 | Wahl | |
| 7,412,984 | B1 * | 8/2008 | Spencer | A45B 3/00 135/16 |
| 8,753,216 | B2 | 6/2014 | Hsieh | |
| 10,932,579 | B2 * | 3/2021 | Murphy | A47C 4/40 |
| 2005/0161067 | A1 * | 7/2005 | Hollins | A45B 23/00 135/16 |
| 2005/0172987 | A1 * | 8/2005 | Byrnes | A45B 3/00 135/33.5 |
| 2008/0018146 | A1 | 1/2008 | Wahl | |
| 2011/0303256 | A1 | 12/2011 | Ashley | |
| 2012/0098306 | A1 * | 4/2012 | Jarnagin | F21V 33/0012 297/217.6 |
| 2014/0265462 | A1 * | 9/2014 | Fleming | A47C 7/666 297/180.14 |
| 2016/0052447 | A1 * | 2/2016 | Salter | B60Q 3/233 297/217.6 |
| 2017/0227988 | A1 * | 8/2017 | Chen | F21S 9/037 |
| 2018/0325336 | A1 * | 11/2018 | Chang | A61L 2/10 |
| 2019/0059596 | A1 * | 2/2019 | Wallace | A47C 7/029 |

FOREIGN PATENT DOCUMENTS

| | | | | |
|---|---|---|---|---|
| JP | 2018065449 | A | 4/2018 | |
| KR | 20070078286 | A * | 7/2007 | |
| KR | 100770221 | B1 * | 10/2007 | |
| KR | 20090108243 | A | 10/2009 | |
| WO | WO-2011004220 | A1 * | 1/2011 | A47C 1/121 |

* cited by examiner

SUNSHADED SWING SEAT

This application claims priority from and is a continuation in part of U.S. utility patent application Ser. No. 16/238,909 entitled Sunshade by the same inventor Samuel Chen filed Jan. 3, 2019, which is a continuation in part of and claims priority from U.S. design patent application 29/661,378 entitled Sunshade by the same inventor Samuel Chen filed Aug. 27, 2018, the disclosures of which are incorporated herein by reference.

FIELD OF THE INVENTION

The present invention is in the field of sunshades and shaded seats.

DISCUSSION OF RELATED ART

A variety of backyard shaded seats been devised for summer comfort. During the summer, backyard shading provides comfort for users. In U.S. Pat. No. 4,030,748 inventor Helmut E. Brook teaches a lounge chair shading structure entitled Sun Shade Apparatus registered Jun. 21, 1977. The abstract describes an elongated strip of flexible plastic having a pair of brackets adjustably pivotably affixed to ends of the sheet, each of the brackets being adjustably positionable along a respective side portion of a conventional lounge chair.

In U.S. Pat. No. 4,865,381 inventor Jobaire V. Van Rouge teaches and attachable sunshade, entitled Sunshade Attachment registered on Sep. 12, 1989. The abstract describes an improved sunshade attachment comprising a first generally U-shaped member releasably securable to a pair of clamps for attaching the sunshade to a desired structure, a second generally U-shaped canopy supporting member releasably attachable to said first U-shaped member, a pair of side arms interposable between said first and second U-shaped members, a canopy for covering said members and providing shade to an area beneath said canopy, and a pair of coil-type screens mountable on either side of said sunshade and extensible to provide lateral protection and privacy.

In U.S. Pat. No. 5,000,210 inventor Thomas D. Worthing, Jr. invented a Sun Shade registered on Mar. 19, 1991. Worthing's abstract briefly explains a sun shade for mounting to a chair or other furniture comprises a support frame including a lateral tube and vertical tubular legs pivotally mounted to the lateral tube. A central clamp is rigidly mounted to the lateral tube and includes a U-shaped opening for engagement over an upper edge portion of the chair. Outboard clamps are slidably positioned on lateral tube and have U-shaped openings for engagement over side edge portions of the chair. Means are provided for resisting the pivotal movement of the tubular legs relative to the lateral tube. A canopy assembly is pivotally mounted to the tubular legs and includes a rectangular frame and a fabric panel.

In U.S. Pat. No. 5,320,405 inventor Marianne Foster discloses a Portable Sunshade that was registered on Jun. 14, 1994. The abstract briefly explains a sunshade comprising a plurality of U-shaped bails, pivotally joined together at each end by a plastic joint. A fabric web ensheathes the balls and creates a shade providing canopy when the balls are spread apart from each other in fan-like fashion. The ends of the cover are fastened together to keep the sunshade clamped shut.

In U.S. Pat. No. 5,967,601 inventor Gary Gillins invented a recreational chair shade entitled Sunshade Apparatus for Recreational Chair registered on Oct. 19, 1999. The Gillins abstract briefly explains a Sunshade apparatus is disclosed for use with recreational chairs having a Seat back. The Sunshade has a rigid Support to which upper edge clips and Side edge clips are connected for releasable attachment to the Seat back upper edge and Seat back Side edge, respectively. The Side edge clips can rotate about the Support in a generally horizontal plane, and the Side edge clips are constructed in a manner to flex in a generally vertical plane. The upper edge clips have a hook portion to enable the Sunshade to hang on the Seat back upper edge. A canopy frame, covered with a shade producing cover, is pivotally attached to the Support. When not in use, the canopy frame can be pivoted to a collapsed, generally flat configuration with the support.

In U.S. Pat. No. 6,789,557 inventor Gene Wahl, Jr. invented the Portable and Collapsible Sunshade Apparatus registered on Sep. 14, 2004. The abstract briefly explains a portable and collapsible sunshade apparatus which can be conveniently folded up and carried in a bag so that the Sunshade apparatus can be easily transported to the beach or other locations for attachment to a beach chair or lounge chair through use of a novel attachment clip. The universal clip enables a sunshade apparatus to be attached to a beach chair or lounge chair at a desired height above the occupant of the chair and at a desired angular orientation relative to the chair.

In U.S. Pat. No. 7,243,990 inventor Gene Wahl invented a sunshade apparatus entitled Sunshade Apparatus registered on Jul. 17, 2007. The abstract briefly explains a sunshade apparatus for shading a chair has a pair of vertical support legs, a pair of attachment elements, a pair of horizontally extending arms, and a flexible canopy element for shading the chair. Each of the attachment elements is attached to a bottom end of one of the support legs and is adapted for mounting the sunshade apparatus on the chair. A locking element functions to lock the pair of horizontally extending arms in the extended configuration with respect to the pair of vertical support legs. A folding element joins the horizontally extending arms and folds.

In US patent publication number US2011/0303256A1 inventor Elaine Ashley invented a Portable Sunshade Apparatus registered on Dec. 15, 2011. The abstract briefly explains a portable sunshade apparatus for use with, for example, a recreational chair. In one embodiment, the sunshade apparatus has two side supports. Each side support has one or more of an attachment provision, a vertical support leg, one or more radial support arms, a ratchet assembly connecting the radial arms to the vertical support leg, and a horizontally extending arm connected to an end of the radial support arms. A canopy element extends between the horizontally extending arms of each side support. The ratchet assembly and the attachment provision include features that allow the canopy to be adjusted in a variety of directions. In some instances, the canopy element is used for displaying promotional messages.

In U.S. Pat. No. 4,898,198 inventor Gerald E. Castlebury invented a Canopy Apparatus for Children's Swings registered Feb. 6, 1990. The canopy attaches to the swingset frame for shading children during play.

In U.S. Pat. No. 5,033,528 inventor Yanon Volcani invented a Personal Portable Sunshade registered Jul. 23, 1991. The abstract briefly explains a portable sunshade comprising a disc having a surface area sufficient for shading a particular portion of a user's body, which disc is supported at its edge by a flexible extension that is connected to a rigid extension that in turn is connected to a lamp or suitable supporting device. The flexible section provides a rotating, bendable gooseneck connection that may be connected directly to the clamp. The clamp, clamps the sunshade to a lounge chair or the like, allowing the disc to be positioned to shade the user's face.

In U.S. Pat. No. 5,000,210 inventor Thomas D. Worthington invented a Sun Shade registered Mar. 19, 1991. The abstract explains that a sun shade for mounting to a chair or other furniture comprises a support frame including a lateral tube and vertical tubular legs pivotally mounted to the lateral tube. A central clamp is rigidly mounted to the lateral tube and includes a U-shaped opening for engagement over an upper edge portion of the chair. Outboard clamps are slidably positioned on lateral tube and have U shaped openings for engagement over side edge portions of the chair. Means are provided for resisting the pivotal movement of the tubular legs relative to the lateral tube. A canopy assembly is pivotally mounted to the tubular legs and includes a rectangular frame and a fabric panel.

In U.S. Pat. No. 5,441,067 inventor Peter James invented a Sunshade for Outdoor Furniture registered on Aug. 15, 1995. The abstract briefly explains the present invention provides for a sun shade arrangement for attachment to outdoor furniture. The arrangement includes a reusable clamping means, an arm having a forward end and a sun shade member having a mounting end piece releasably secured to the forward end of the arm. The arm includes spaced apart bars removably and adjustably secured to the clamping means. The spaced apart bars are connected to one another at the forward end of the arm and provide a releasable connection for the mounting end piece of the sun shade member.

In U.S. Pat. No. 6,405,742 inventor James J. Driscoll invented a Portable Sun Shade registered on Jun. 18, 2002. The abstract briefly explains a sun shade having an elongated member laterally supported from the end of a pole by a universal joint permitting rotational and angular movement of the member with respect to the longitudinal axis of the pole itself. The pole includes a telescoping arrangement whereby the pole can be lengthened or shortened at the discretion of the user. The end of the pole opposite to its end carrying the member includes a universal mount connected to a firm anchor or support by a suitable clamp.

In U.S. Pat. No. 4,639,036 inventor James O. Nichols invented a Sun Shade Apparatus for a Lounge Chair registered on Jan. 27, 1987. The abstract briefly explains the present invention is directed to sun shade apparatus for a chair or similar structure. The apparatus includes adjustment mechanisms for orienting the canopy sheet with respect to the chair for shade, for use as a tray or for stowage. The apparatus is easily attached to the chair with clamping mechanisms which are attached to the legs of a frame member.

In U.S. Pat. No. 5,397,268 inventor Kil J. Chang invented a Integrated SunShade and Fan Apparatus registered on Mar. 14, 1995. The abstract briefly explains an integrated sunshade and fan apparatus includes a personal portable sunshade device and a fan assembly integrated thereon which together respectively shade a selected portion of a user's body and generate a cooling airflow over a substantial portion of the user's body. The sunshade device includes a shading disc having a surface area sized for shading a portion of the user's body and a mounting assembly attached to the shading disc for mounting the device to a support structure, such as a chair side. The shading disc has an opening formed there through within the peripheral edge of the disc. The fan assembly includes a holding structure attached on the shading disc about the opening there through and a fan unit supported by the holding structure in alignment with the opening. The fan unit is operable for generating and directing an airflow through the opening in the shading disc.

In US patent publication number US20080018146A1 inventor Eugene Wahl invented a Sunshade Apparatus registered on Jan. 24, 2008. The abstract briefly explains a Sunshade apparatus for shading a chair has a flexible canopy element, a Support structure for Supporting the flexible canopy element above the chair, and a pair of attachment elements. Each of the attachment elements is attached to the support structure for mounting the flexible canopy element above the chair. Each of the pair of attachment elements includes a clamp having a first locking portion hingably attached to a second locking portion, and a locking screw for clamping the first and second locking portions around a tubular element of the chair.

In U.S. Pat. No. 6,293,292 inventor Ben Watzke invented a Sun Shade registered on Sep. 25, 2001. The abstract briefly explains A sun shade, for use by an individual in blocking the sun from the face and head of that individual, in conjunction with an article of outdoor furniture having a furniture member. The sun shade comprises a blocking panel, a clamp for attaching to the furniture member, and a extendible arm for positioning the blocking panel between. the face of the individual and the sun. The blocking panel includes a pair of blocking panel frame members which are selectively bowed outward to stretch a stretchable fabric panel there between to define the blocking panel, and selectively straighten to allow for storage of the sun shade while the stretchable fabric folds there between.

In U.S. Pat. No. 3,738,703 inventor Takateru Kunimatu invented a Sunshade for Foldable Chair or Bed registered on Jun. 12, 1973. The abstract briefly explains a sunshade to be mounted on the back-rest member of a foldable chair or bed such as a three-fold chair primarily for an outdoor use. The sunshade comprises an awning sheet frame and a pair of support legs pivoted to one end thereof to support the frame shiftably in accordance with the reclination of the back-rest member and the direction of the striking sunlight. The support legs are formed at their lower parts with elongated ring like portions in facing relation to each other for clamping the opposite shoulders of the back-rest member. The distance between a pair of the opposing support legs is smaller at their intermediate portions than the width of the back-rest member, whereby the support legs are resiliently urged inward about the pivoted portions when clamping the shoulders of the back-rest member from outside.

In U.S. Pat. No. 7,048,333 inventor Robert E. Martinez invented a Collapsible Sun Shade for a Chair registered on May 23, 2006. The abstract describes, "A collapsible sun shade adapted to be used with a chair is disclosed. The shade is made of spring steel or equivalent material and is adapted to be affixed to cover the seat portion of a lounge chair. The shade is unfolded under the force of the compressed spring and attached to the chair to provide shade over the seat of the chair."

In U.S. Pat. No. 5,135,281 inventor Edward Pappalardo invented a Sunshade registered on Aug. 4, 1992. The abstract briefly explains that this invention relates to chair sunshades, especially to chair sunshades where the sunshade is intended to be collapsible and detachable from its frame, and is made of a disposable, replaceable, and imprintable type of material.

In U.S. Pat. No. 5,096,257A inventor Brian L. Clark invented the Sunshade Apparatus for Chair registered on Mar. 17, 1992. The abstract describes "an adjustable sunshade apparatus for providing shade to a person in a recreational chair, the apparatus comprising a canopy structure for supporting a fabric cover and adjustably attached to two parallel shade support arms. A pair of clamps holds the shade support arms to the back of the chair. The canopy structure is dismantled so that the support arms and canopy components lie adjacent and parallel, and so that the clamps, canopy components, and support arms may be wrapped in the fabric cover to achieve a conveniently carried roll. The sunshade apparatus is easily assembled, dismantled, and ported."

SUMMARY OF THE INVENTION

A sunshaded swing seat includes a suspension frame including a main horizontal beam, and a pair of extension members mounted to the main horizontal beam. The pair of extension members forms four tips. Tension supports extend downwardly from the four tips, and each tension support extends downwardly from each tip. A swing seat has a rigid swing seat rim, and the swing seat has a fabric seat body attached to the swing seat rim and forming a seat hollow. A shade has a upper panel mounted over the swing seat.

The shade optionally further includes a shade left side panel and a shade right side panel. The shade left side panel has a shade left arc on its lower edge and the shade right side panel has a shade right arc on its lower edge. The shade left arc terminates at a shade left side panel front tip, and the shade right arc terminates at a shade right side panel front tip. The shade left side panel front tip is connected to one of the tension supports by a left front lower strap, and the shade right side panel front tip is connected to one of the tension supports by a right front lower strap.

The shade upper panel forms a shade left bend at an angle less than 90° when a left front upper strap connects the shade left side panel to one of the tension supports; and the shade upper panel forms a shade right bend at an angle less than 90° when a right front upper strap connects the shade right side panel to one of the tension supports. The tension supports are optionally made of chain linkage and connected to an extension member via an extension member connector, and the tension supports are connected to the extension member connector using a snap hook. The chain linkage is at least partially enclosed by support sheathing. The pair of extension members can be formed as shade panel flexible members.

Preferably, the swing seat includes a water system and a light system. The light system is electrically powered and can be solar powered such as by photovoltaic charging of a rechargeable battery. The light system preferably includes an upper light and a lower light. The lower light is mounted on an underside of the seat hollow. The water system should have a water line panel connector connecting to the main water line. The water line panel connector connects to a side panel water line. The side panel water line connects to a side panel lower edge water line. The side panel lower edge water line is configured to receive a plurality of spray heads.

The shade further has a shade left side panel and a shade right side panel. The shade further includes a shade panel light mounted to the upper panel. The plurality of spray heads has a front lower mist spray head, a rear lower mist spray head, a front upper mist spray head, and a rear upper mist spray head. The front water line receives a front right mist spray head, a front middle mist spray head and a front left mist spray head. The front water line is connected to the main water line at the front water line connector. The front water line connector is mounted above the swing seat.

The following call out list of elements can be a useful guide in referencing the element numbers of the drawings.

11 Shade Panel Flexible Member End Cap
12 Shade Panel Connector
13 Shade Panel Flexible Member
14 Shade Panel
15 Shade Panel Connector Clamp
16 Shade Panel Spring
17 Shade Panel Connector Linkage
21 Main Horizontal Beam
22 Beam Bracket
23 Beam Bracket Bolt
24 Rounded Beam Top
25 Horizontal Extension Beam
26 Extension Beam Bolt
27 Extension Beam Washer
28 Extension Beam Cap
29 Extension Beam Connector
30 Shade
31 Shade Upper Panel
32 Shade Right Side Panel
33 Shade Left Side Panel
34 Shade Right Bend
35 Shade Left Bend
36 Shade Right Arc
37 Shade Left Arc
42 Right Front Upper Strap
43 Left Front Upper Strap
44 Right Front Lower Strap
45 Left Front Lower Strap
46 Shade Right Side Panel Front Tip
47 Shade Left Side Panel Front Tip
48 Right Rear Upper Strap
49 Right Rear Lower Strap
50 Swing Seat
51 Swing Seat Rim
52 Fabric Seat Body
53 Fabric Body Opening
54 Seat Hollow
55 Front Seat Connector Pair
56 Rear Seat Connector Pair
61 Front Right Support
62 Front Left Support
63 Rear Right Support
64 Rear Left Support
65 Support Sheathing
66 Snap Hook
67 Chain Linkage
68 Locking Link Connector
70 Vertical Supports

71 Front Right Vertical Support
72 Front Left Vertical Support
73 Rear Right Vertical Support
74 Rear Left Vertical Support
80 Water System
81 Main Water Line
82 Water Line Panel Connector
83 Side Panel Water Line
84 Side Panel Lower Edge Water Line
85 Side Panel Lower Edge Water Line Connector
86 Front Lower Mist Spray Head
87 Rear Lower Mist Spray Head
88 Front Upper Mist Spray Head
89 Rear Upper Mist Spray Head
90 Front Water Line
91 Front Right Mist Spray Head
92 Front Middle Mist Spray Head
93 Front Left Mist Spray Head
94 Front Water Line Connector
100 Light System
101 Upper Light
102 Lower Light
103 Shade Panel Light

DETAILED DESCRIPTION OF THE PREFERRED EMBODIMENT

Figure 1:
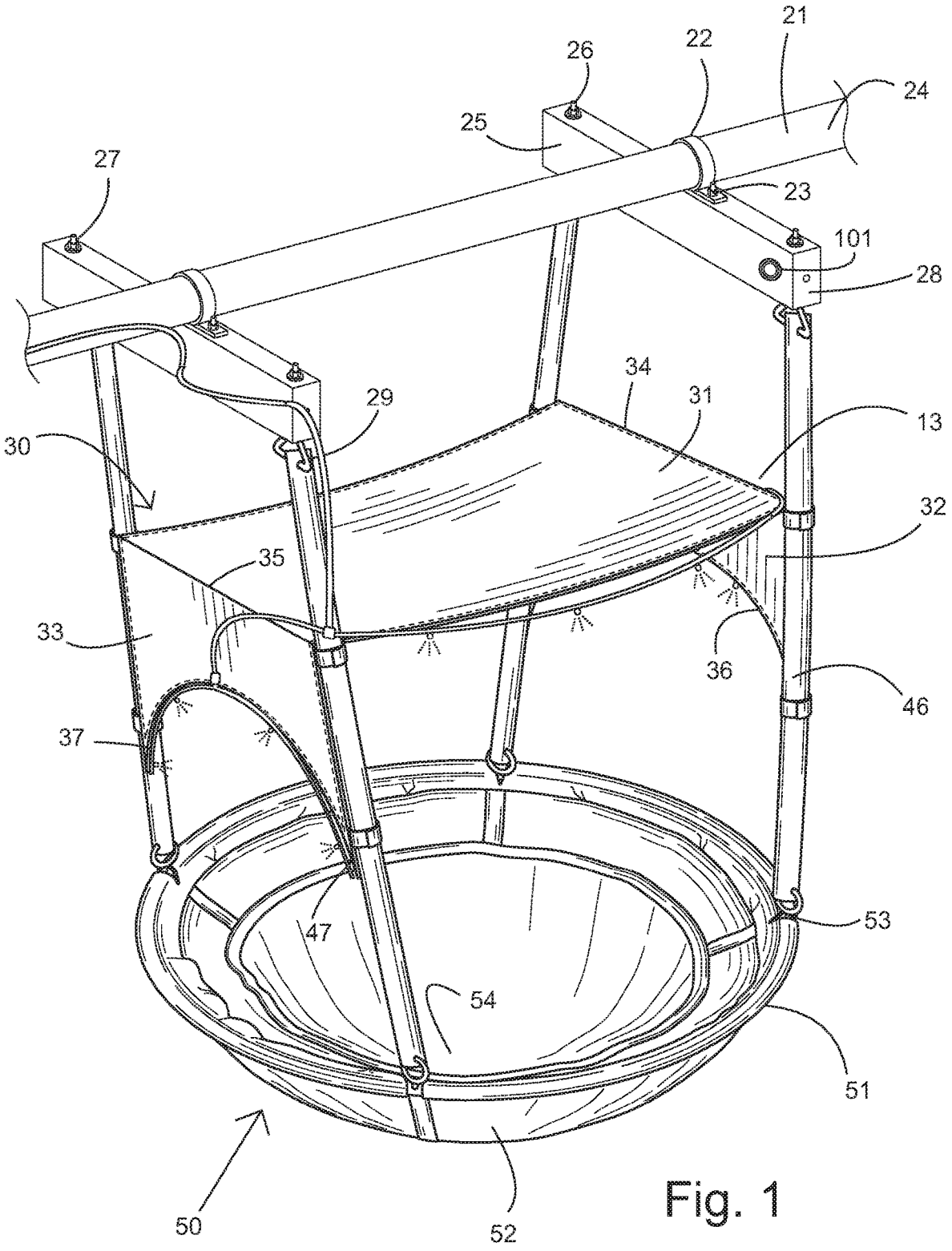
FIG. 1 is a perspective view of the present invention.

As seen in the first figure, FIG. 1, the present invention has a shade panel flexible member 13 supported in a horizontal position. A framework supports the shade panel flexible member 13. The shade panel flexible member can be semi rigid or a fabric sheet. Preferably, it is configured for outdoor use such as by providing ultraviolet resistance in nylon fabric fibers. In a first mode, the shade can be secured underneath the horizontal extension beam 25, and in a second mode, the shade is removable and can be placed over the horizontal extension beam 25. The shade can be removable by hook and loop tape straps, magnets, or the like.

The shade 30 has a shade upper panel 31 which can be formed as a shade panel flexible member 13 or can be formed as a fabric panel that is not semi rigid. The shade 30 further includes a shade right side panel 32 and a shade left side panel 33 flanking the right and left sides of the shade 30. At the right side of the shade upper panel 31, the shade right side panel 32 bends downward at a shade right bend 34 and at the left side of the shade upper panel 31, the shade left side panel 33 bends downward at a shade left bend 35. The shade right side panel 32 has a shade right arc 36 at a lower edge of the shade right side panel 32 and the shade left side panel 33 has a shade left arc 37 at a lower edge of the shade left side panel 33. The arc shape forms a pair of rear tips and a pair of front tips. The pair of front tips includes a shade right side panel front tip 46 and a shade left side panel front tip 47.

The shade 30 and seat structure can be supported by a main horizontal beam 21 formed as a tubular metal pipe. A pair of brackets such as a beam bracket 22 can be connected to a pair of horizontal beams such as horizontal extension beam 25 using connectors such as bolts, here namely the beam bracket bolt 23. The main horizontal beam 21 preferably has a rounded beam top 24.

A total of four extension beam bolts 26 are backed by extension beam washers 27 to connect them to the horizontal extension beams 25. The extension beam bolts 26 can be connected to extension beam connectors 29 at the pair of ends of the pair of extension beams. At each end of the pair of ends of the pair of extension beams, a total of four extension beam caps 28 can cover the ends. The extension beam caps 28 can be made of plastic rectangular members that friction fit into the open metal rectangular tubes of the extension beams.

The swing seat 50 is connected to the support structure and suspended from ends of the extension beams at chain suspension members. The swing seat 50 has a swing seat rim 51, a fabric seat body 52, a fabric body opening 53, and a seat hollow 54. The seat hollow 54 holds users or articles within it. The seat rim 51 can be formed of a rigid tubular metal structure and the fabric body opening 53 can be formed at regular intervals for allowing attachment of the vertical supports 70. The vertical supports 70 act as vertical suspension members to maintain the position of the rigid tubular metal structure of the seat rim 51. The vertical supports 70 can be formed as chains achieved in a polyethylene sleeve. The fabric seat body 52 is also preferably ultraviolet stabilized and can be made of the same color and material as the shade 30. The shade 30 is positioned over the swing seat 50.

Figure 2:
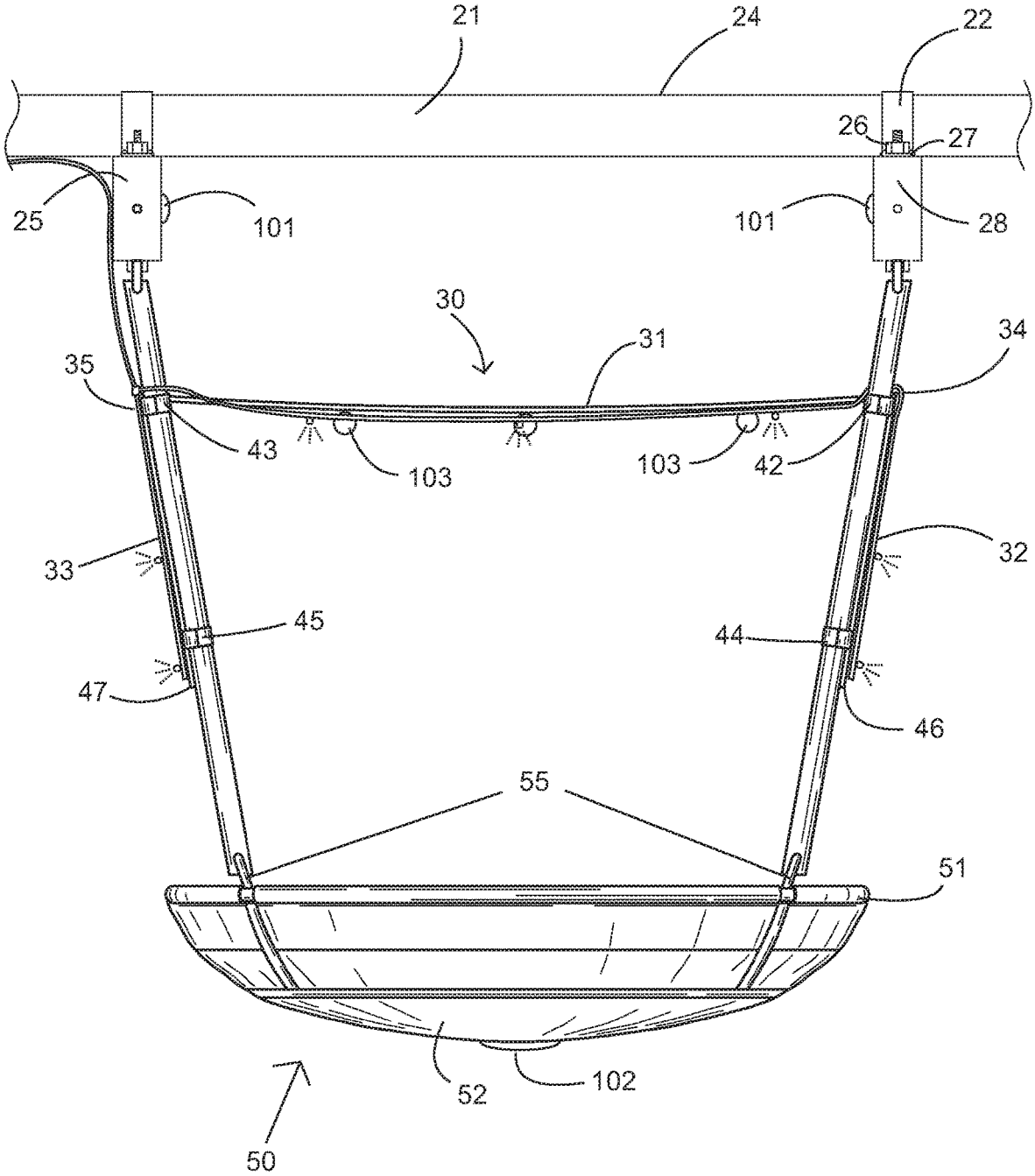
FIG. 2 is a front view of the present invention.
Figure 3:
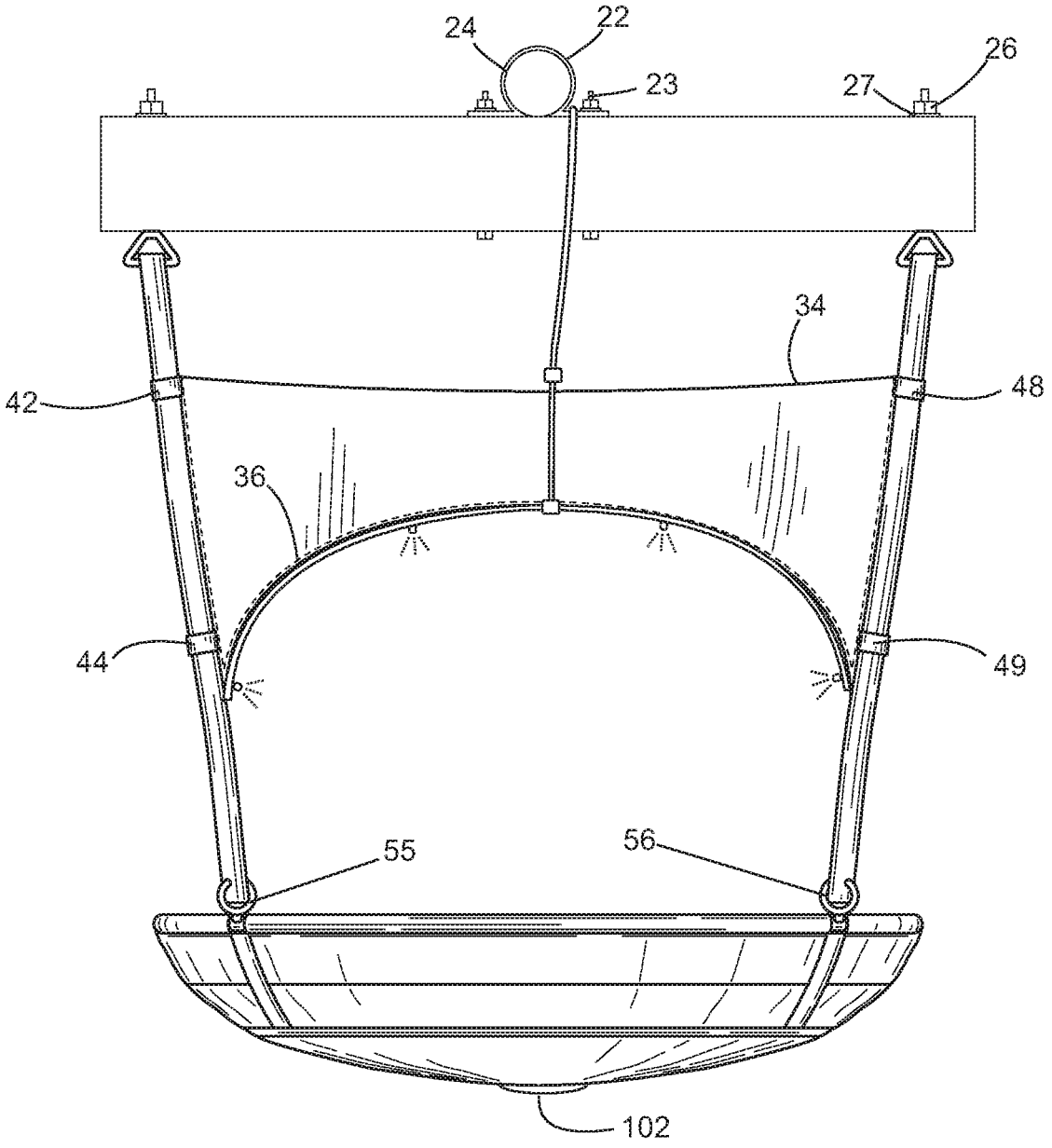
FIG. 3 is a side view of the present invention.

As seen in the second figure, FIG. 2, the suspension frame includes the main horizontal beam 21, the beam bracket 22, the rounded beam top 24, the horizontal extension beam 25, the extension beam bolt 26, the extension beam washer 27 and the extension beam cap 28. The shade 30 includes the shade upper panel 31, the shade right side panel 32, the shade left side panel 33, the shade right bend 34, and the shade left bend 35. The shade structure is connected at four locations including a right front upper strap 42, a left front upper strap 43, a right front lower strap 44, a left front lower strap 45, a shade right side panel front tip 46, and a shade left side panel front tip 47. The swing seat 50 includes a swing seat rim 51, fabric seat body 52, a rear seat connector pair and a front seat connector pair 55.

The shade right bend 34 and the shade left bend can be greater than 90° because each of the right front upper strap 42, right front lower strap 44, right rear upper strap 48, and right rear lower strap 49 connect the vertical supports to the shade 30. The vertical supports preferably are angled inwardly. The front seat connector pair 55 and the rear seat connector pair 56 are preferably formed as links that connect to the vertical supports.

Figure 4:
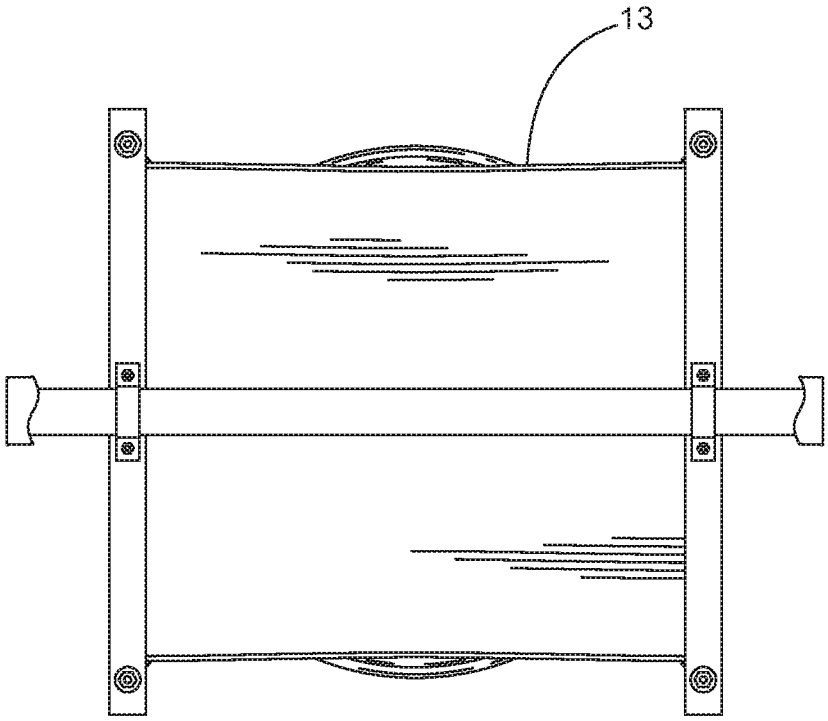
FIG. 4 is a top view of the present invention.
Figure 5:
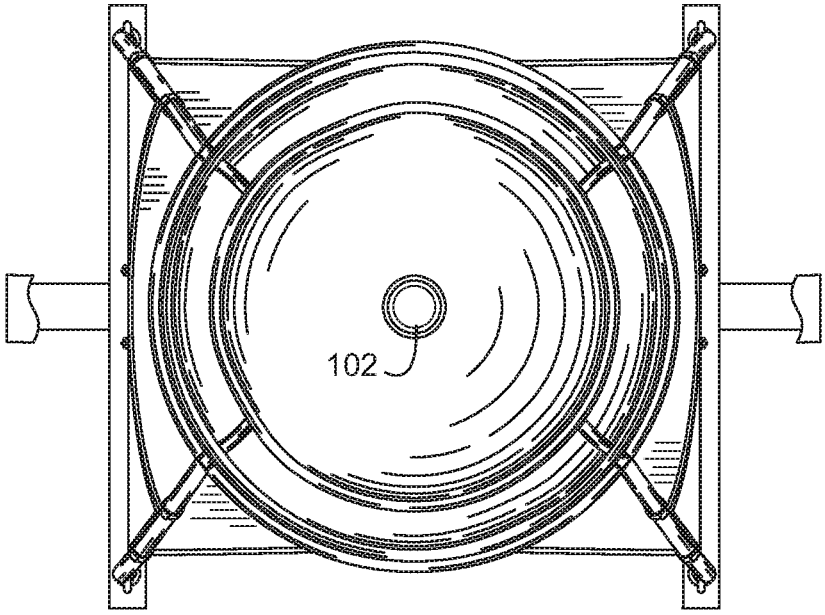
FIG. 5 is a bottom view of the present invention.

As seen in the fourth figure, FIG. 4, the shade panel flexible member 13 can be formed as a generally rectangular sheet. As seen in the fifth figure, the vertical supports 70 include a front right vertical support 71, a front left vertical support 72, a rear right vertical support 73, and a rear left vertical support 74.

Figure 6:
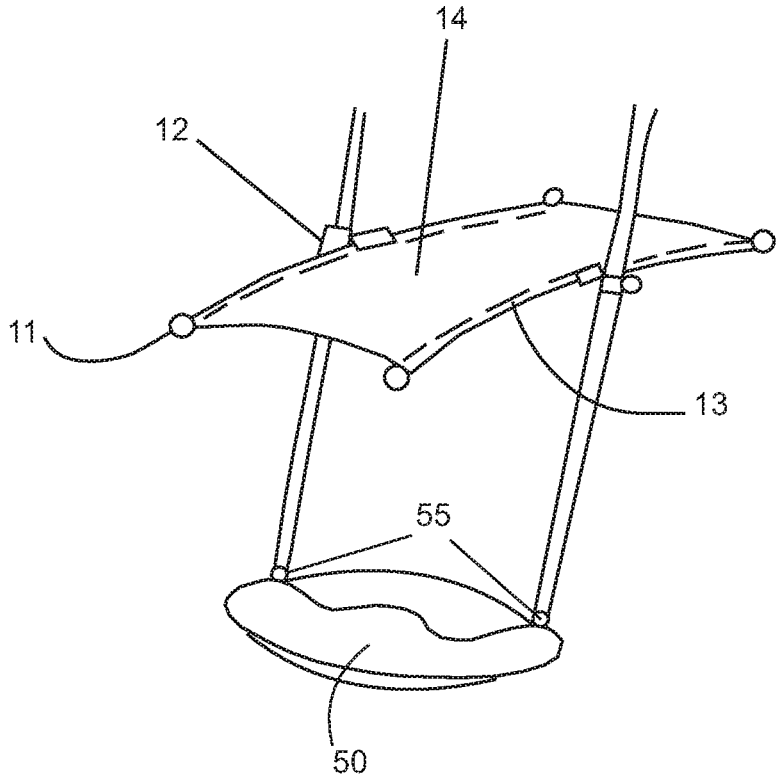
FIG. 6 is a perspective view of the present invention showing a shade panel connector over a blow molded plastic swing seat having a hollow.

As seen in FIG. 6, the shade panel 14 can be mounted on a shade panel flexible member 13. The shade panel flexible member 13 connects to and extends from the front right vertical support 71 and the front left vertical support 72. The shade panel flexible member 13 connects to the vertical supports at the shade panel connector 12. The shade panel flexible members 13 can be formed as flexible tubes which are analogous to the extension beams. The extension beams are generally rigid whereas the shade panel flexible members 13 are flexible. The shade panel flexible members 13 can have a flexible member cap 11 to cover the shade panel flexible member tips. The shade panel 14 can extend between the pair of vertical support members.

Figure 7:
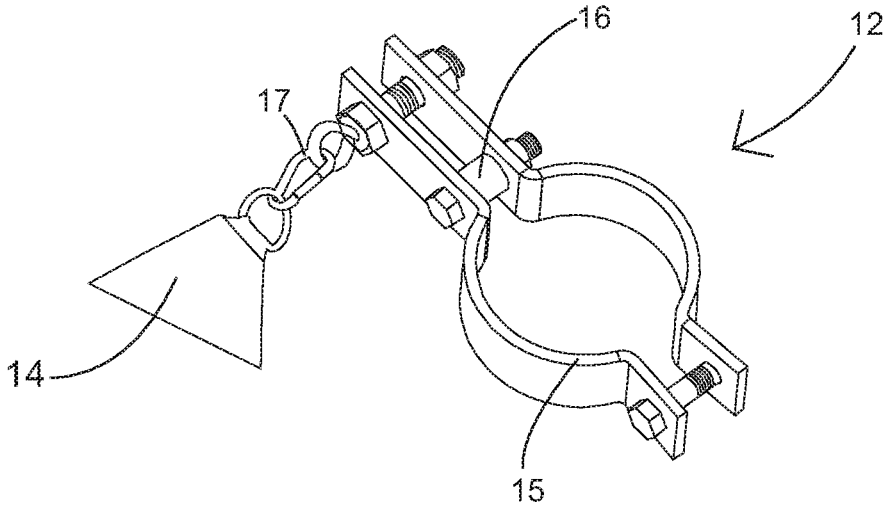
FIG. 7 is a detail diagram of a shade panel connector.

As seen in FIG. 7, the shade panel connector 12 can be formed as a bracketed or clamp connection. The shade panel connector 12 is attached to the shade panel 14 at a shade panel connector link 17. The shade panel connector 12 can be formed with a shade panel connector clamp 15 that is biased into a closed position at a shade panel spring 16. The shade panel connector linkage 17 can be formed as a snap hook.

Figure 8:
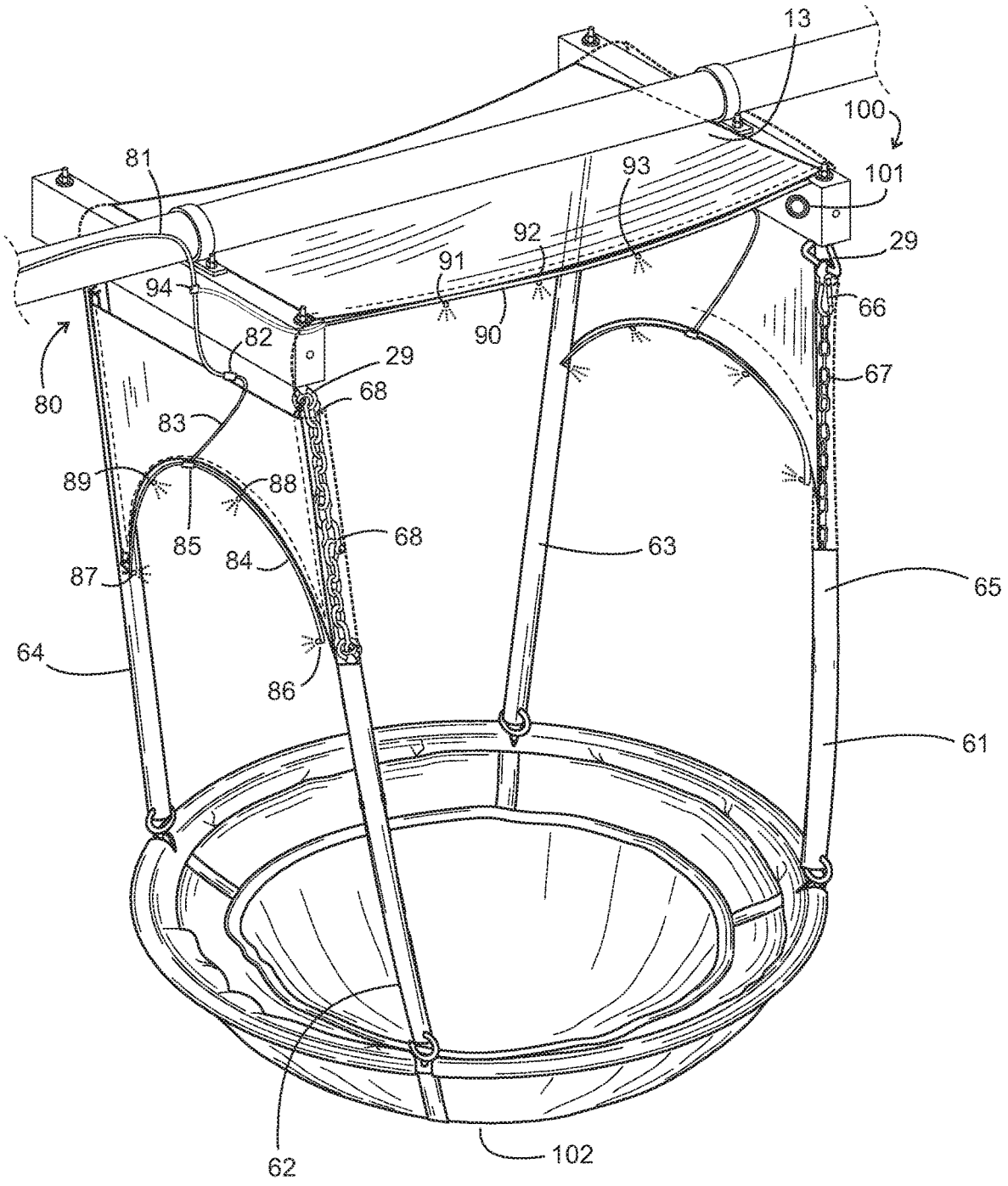
FIG. 8 is a cut away section diagram showing connection hardware when mounting the shade over the horizontal extension beam.

As seen in FIG. 8, the vertical supports 70 can be arranged into four generally vertical chain assemblies which include a front right support 61, a front left support 62, a rear right support 63, a rear left support 64 all covered by support sheathing 65. Alternatively, the shade panel flexible member 13 can be attached to an upper surface of the extension beams. The extension beam connector 29 can be made as a circular or triangular member. Additionally, an extension beam connector 29 can be connected to a support by using a snap hook 66 that connects to chain linkage 67. A locking link connector 68 can connect a section of chain linkage 67 to another section of chain linkage 67.

As seen in FIG. 2, a light system 100 can be implemented on the swing seat. The light system 100 and preferably includes an upper light 101 mounted on the horizontal extension beam 25. A lower light 102 can be mounted on an underside of the seat hollow 54. The lower light 102 can be made as an LED light with a battery compartment holding a battery. The lower light 102 is preferably in the shape of a flat circular disk and may have an elastomeric housing and lens. The lower light 102 is centered in the middle of the seat hollow 54 on a lower surface of the seat hollow 54 and can be mounted by stitching. The shade upper panel 31 may have one or more shade panel lights 103 suspended from a front or rear edge of the shade upper panel 31. The shade upper panel 31 can have a front hem that retains an electrical line for powering the shade panel lights 103.

As seen in FIG. 8, a water system 80 is attached to the sunshaded swing seat. The water system 80 includes a main line 81 mounted to the main horizontal beam 21, or mounted inside the main horizontal beam 21. The water main line preferably extends from a swing frame leg. In a typical a frame swing frame, a pair of right legs, and a pair of left legs extend diagonally from the ground to a left apex and a right apex. The left apex and the right apex support the main horizontal beam 21.

The main line 81 preferably connects to a front water line connector 94 which is formed as a branching T junction to provide a right branch and a left branch. The main line 81 connects to a water line panel connector 82 which connects to a right panel. The right panel has a side panel water line 83 and the side panel water line 83 connects to a side panel lower edge water line connector 85. The side panel lower edge water line 84 can have mist spray heads attached to it. For example, a front lower mist spray head 86, a rear lower mist spray head 87, a front upper mist spray head 88, and a rear upper mist spray head 89 can be mounted to the side panel lower edge water line 84.

The front water line connector 94 is a junction that provides water to the front water line 90. The front water line 90 can have a front right mist spray head 91, a front middle mist spray head 92, and a front left mist spray head 93 mounted to the front water line 90. The front water line 90 can pass to the left side of the sunshaded swing seat so that it attaches to a left panel with the same structure as the right panel. The left panel may also have a side panel lower edge water line with mist spray heads attached to it. A left front lower mist spray head, a left rear lower mist spray head, a left front upper mist spray head, and a left rear upper mist spray head can be mounted to the left side panel lower edge water line. The left panel is symmetrical to the right panel. The right panel may also have a side panel lower edge water line with mist spray heads attached to it. A right front lower mist spray head, a right rear lower mist spray head, a right front upper mist spray head, and a right rear upper mist spray head can be mounted to the right side panel lower edge water line.

The invention claimed is:

1. A sunshaded swing seat comprising:

a. a suspension frame including a main horizontal beam, and a pair of extension members mounted to the main horizontal beam, wherein the pair of extension members forms four tips;

b. tension supports extending downwardly from the four tips, wherein each tension support extends downwardly from each tip;

c. a swing seat having a rigid swing seat rim, wherein the swing seat has a fabric seat body attached to the swing seat rim and forming a seat hollow radially inside and protruding downwardly from the rigid swing seat rim;

d. a shade having an upper panel mounted over the swing seat;

e. a light system, wherein the light system further includes an upper light and a lower light, wherein the lower light is mounted on an underside of the seat hollow; and f. a water system, wherein the water system further includes a main water line, a water line panel connector connecting to the main water line, wherein the water line panel connector connects to a side panel water line, wherein the side panel water line connects to a side panel lower edge water line, wherein the side panel lower edge water line is configured to receive a plurality of spray heads.

2. The sunshaded swing seat of claim 1, wherein the shade further comprises a shade left side panel and a shade right side panel, wherein the shade further includes a shade panel light mounted to the upper panel; and wherein the plurality of spray heads comprises a front lower mist spray head, a rear lower mist spray head, a front upper mist spray head, and a rear upper mist spray head.

3. The sunshaded swing seat of claim 2, further including a front water line, wherein the front water line receives a front right mist spray head, a front middle mist spray head and a front left mist spray head, wherein the front water line is connected to the main water line at the front water line connector, wherein the front water line connector is mounted above the swing seat.

4. The sunshaded swing seat of claim 2, wherein the shade left side panel has a shade left arc on its lower edge and wherein the shade right side panel has a shade right arc on its lower edge.

5. The sunshaded swing seat of claim 4, wherein the shade left arc terminates at a shade left side panel front tip, and wherein the shade right arc terminates at a shade right side panel front tip.

6. The sunshaded swing seat of claim 5, wherein the shade left side panel front tip is connected to one of the tension supports by a left front lower strap, and wherein the shade right side panel front tip is connected to one of the tension supports by a right front lower strap.

7. The sunshaded swing seat of claim 6, wherein the shade upper panel forms a shade left bend at an angle less than 90° when a left front upper strap connects the shade left side panel to one of the tension supports; and wherein the shade upper panel forms a shade right bend at an angle less than 90° when a right front upper strap connects the shade right side panel to one of the tension supports.

8. The sunshaded swing seat of claim 1, wherein the tension supports are made of chain linkage and connected to the pair of extension members via extension member connectors, wherein the tension supports are connected to the extension member connector using a snap hook.

9. The sunshaded swing seat of claim 8, wherein the tension supports are made of a chain linkage which is at least partially enclosed by support sheathing.

10. The sunshaded swing seat of claim 1, wherein the pair of extension members are formed as shade panel flexible members.

11. The sunshaded swing seat of claim 10, wherein the shade further comprises a shade left side panel and a shade right side panel.

12. The sunshaded swing seat of claim 11, wherein the shade left side panel has a shade left arc on its lower edge and wherein the shade right side panel has a shade right arc on its lower edge.

13. The sunshaded swing seat of claim 12, wherein the shade left arc terminates at a shade left side panel front tip, and wherein the shade right arc terminates at a shade right side panel front tip.

14. The sunshaded swing seat of claim 13, wherein the shade left side panel front tip is connected to one of the tension supports by a left front lower strap, and wherein the shade right side panel front tip is connected to one of the tension supports by a right front lower strap.

15. The sunshaded swing seat of claim 14, wherein the shade upper panel forms a shade left bend at an angle less than 90° when a left front upper strap connects the shade left side panel to one of the tension supports; and wherein the shade upper panel forms a shade right bend at an angle less than 90° when a right front upper strap connects the shade right side panel to one of the tension supports.

16. The sunshaded swing seat of claim 10, wherein the tension supports are made of chain linkage and connected to an extension member via an extension member connector, wherein the tension supports are connected to the extension member connector using a snap hook.

17. The sunshaded swing seat of claim 10, wherein the chain linkage is at least partially enclosed by support sheathing.

* * * * *